US006581519B1

(12) United States Patent
Adams

(10) Patent No.: US 6,581,519 B1
(45) Date of Patent: Jun. 24, 2003

(54) BLASTING CAP INITIATOR SYSTEM

(76) Inventor: Leslie K. Adams, 6413 NW. 200th St., Hialeah, FL (US) 33015-2147

( * ) Notice: Subject to any disclaimer, the term of this patent is extended or adjusted under 35 U.S.C. 154(b) by 0 days.

(21) Appl. No.: 09/975,154

(22) Filed: Oct. 11, 2001

(51) Int. Cl.[7] ..... C06C 5/06
(52) U.S. Cl. ..... 102/275.11; 102/275.6
(58) Field of Search ..... 102/275.6, 275.11

(56) References Cited

U.S. PATENT DOCUMENTS

| | | | | | |
|---|---|---|---|---|---|
| 4,479,436 | A | * | 10/1984 | Wilson | 102/275.11 |
| 4,911,058 | A | * | 3/1990 | Andersson et al. | 102/275.11 |
| 4,911,251 | A | * | 3/1990 | George et al. | 102/275.11 |
| 4,962,708 | A | * | 10/1990 | Snyder et al. | 102/275.11 |
| 5,365,851 | A | * | 11/1994 | Shaw | 102/275.6 |
| 5,571,986 | A | * | 11/1996 | Snider et al. | 102/275.11 |
| 5,703,320 | A | * | 12/1997 | Lucca et al. | 102/275.11 |
| 6,305,287 | B1 | * | 10/2001 | Capers et al. | 102/275.11 |

FOREIGN PATENT DOCUMENTS

| | | | | |
|---|---|---|---|---|
| WO | WO 94/15168 | * | 7/1994 | 102/275.11 |

* cited by examiner

*Primary Examiner*—Peter A. Nelson
(74) *Attorney, Agent, or Firm*—Edward P. Dutkiewicz

(57) ABSTRACT

A blasting cap initiator system has a main housing with an imperforate lower wall, parallel side walls, and front and rear walls. An L-shaped locking slot is formed centrally in one side wall with a trigger recess formed in the top wall adjacent the rear wall and a cylindrical bore extending from the rear wall through the front wall. A firing pin is mounted for reciprocal movement within the bore between a retracted orientation and an advanced orientation. The firing pin has a centrally located circumferential groove. A trigger is pivotably mounted in the trigger recesses movable between a locking orientation with a finger engageable with the groove and a raised orientation to a disengage orientation. A pair of axial coil springs between the rear wall and the cylinders independently allow the advancement of the cylinders.

5 Claims, 4 Drawing Sheets

FIG 3
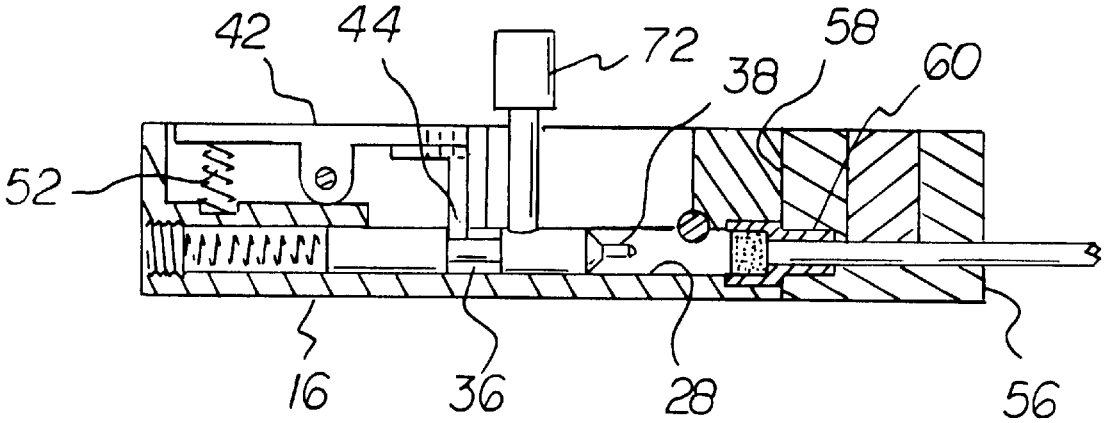
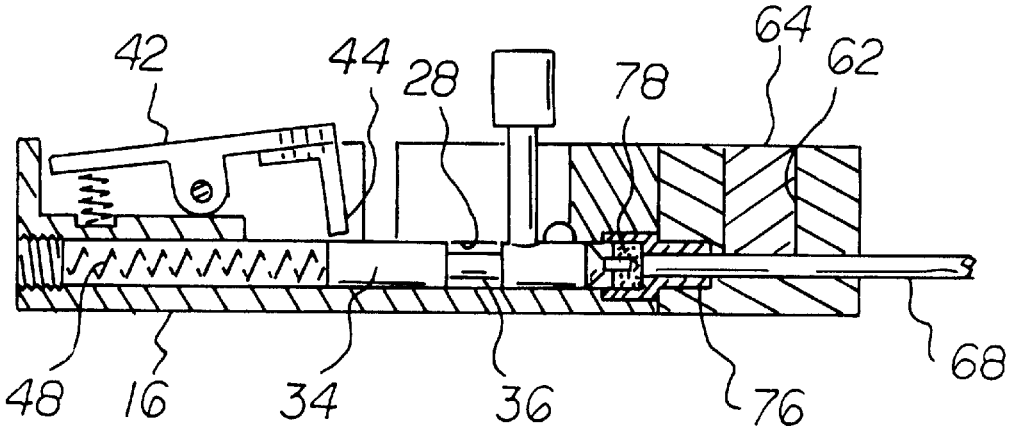
FIG 4

76
78
80
84

BLASTING CAP INITIATOR SYSTEM

BACKGROUND OF THE INVENTION

1. Field of the Invention

The present invention relates to a blasting cap initiator system and more particularly pertains to initiating a shot shell primer and then a shock tube which in turn activates a blasting cap in a safe and efficient manner.

2. Description of the Prior Art

The use of shock tube activators of known designs and configurations is known in the prior art. More specifically, shock tube activators of known designs and configurations previously devised and utilized for the purpose of initiating blasting caps through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,657,958 to Welles discloses a safe-armed explosive initiation device. U.S. Pat. No. 4,381,711 to Lawrence discloses a hand-held shot tube detonator. U.S. Pat. No. 4,479,436 to Wilson discloses a device for igniting safety fuse. U.S. Pat. No. 4,911,251 to George et al. discloses a method and apparatus for actuating a tubing conveyed perforating gun. U.S. Pat. No. 4,962,708 to Snyder et al. discloses an electric/non-electric initiation system. U.S. Pat. No. 5,327,835 to Adams et al. discloses a detonation device including coupling means. U.S. Pat. No. 5,365,851 to Shaw discloses an initator device. U.S. Pat. No. 5,615,911 to Amano discloses a mechanical ignition sensor. Finally, U.S. Pat. No. 5,415,099 to Kitazawa et al. discloses a mechanical ignition sensor.

While these devices fulfill their respective, particular objectives and requirements, the aforementioned patents do not describe a blasting cap initiator system that allows initiating a shot shell primer and then a shock tube which in turn activates a blasting cap in a safe and efficient manner.

In this respect, the blasting cap initiator system according to the present invention substantially departs from the conventional concepts and designs of the prior art, and in doing so provides an apparatus primarily developed for the purpose of initiating a shot shell primer and then a shock tube which in turn activates a blasting cap in a safe and efficient manner.

Therefore, it can be appreciated that there exists a continuing need for a new and improved blasting cap initiator system which can be used for initiating a shot shell primer and then a shock tube which in turn activates a blasting cap in a safe and efficient manner. In this regard, the present invention substantially fulfills this need.

SUMMARY OF THE INVENTION

In view of the foregoing disadvantages inherent in the known types of shock tube activators of known designs and configurations now present in the prior art, the present invention provides an improved blasting cap initiator system. As such, the general purpose of the present invention, which will be described subsequently in greater detail, is to provide a new and improved blasting cap initiator system and method which has all the advantages of the prior art and none of the disadvantages.

To attain this, the present invention essentially comprises a main housing. The main housing has an imperforate lower wall, parallel side walls, and a front wall and a rear wall. An L-shaped locking slot is formed centrally in each side wall adjacent the rear wall. A pair of cylindrical bores extend from the rear wall through the front wall. Safety apertures are formed in the side wall adjacent to the front wall. The main housing also has trigger recesses. Next provided is a pair of cylindrical firing pins. The firing pins are mounted for independent reciprocal movement within the bores between a retracted orientation adjacent to the rear wall. The firing pins are formed with a centrally located circumferential groove and a forwardly extending point. A pair of triggers is next provided. The triggers are pivotably mounted in the trigger recesses and are independently movable to a locking orientation flat with the upper surface. The triggers have a finger engageable with an associated groove for retaining the firing pin in a retracted orientation. The triggers are independently movable to a raised orientation to a disengaged orientation to allow the forward movement of the firing pins. Next provided is a pair of axial coil springs. The axial coil springs are between the rear wall and the firing pins. The axial coil springs independently allow the advancement of the firing pins. A pair of radial coil springs is next provided. The radial coil springs urge the triggers to the locking orientation. Further provided is a forward block. The forward block has a rearward wall positionable in contact with the front wall of the main housing. Apertures are aligned with the bores. The forward block has a recess with a retention member and a coupling thumb screw supporting a pair of ignitor tubes adjacent to the front wall of the housing. Next provided is a radial cocking knob. The radial cocking knob is coupled to each trigger and functions to allow a user to independently withdraw a firing pin to a retracted position and is rotated within an L-shaped locking slot prior to locking by a trigger. Two sleeves are next provided. The sleeves span the housing and the forward block. The sleeves receive a shot shell primer for being initiated by the firing pin point and then the shock tube and finally a remote blasting cap. Further provided is a locking safety rod. The locking safety rod is positionable through safety apertures of the housing. Lastly, an elongated rod is provided. The elongated rod extends through the length of the housing and is threadedly received by the forward block for the removal of a spent shot shell primer and the introduction of a new shot shell primer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved blasting cap initiator system which has all of the advantages of the prior art shock tube activators of known designs and configurations and none of the disadvantages.

It is another object of the present invention to provide a new and improved blasting cap initiator system which may be easily and efficiently manufactured and marketed.

It is further object of the present invention to provide a new and improved blasting cap initiator system which is of durable and reliable constructions.

An even further object of the present invention is to provide a new and improved blasting cap initiator system which is susceptible of a low cost of manufacture with regard to both materials and labor, and which accordingly is then susceptible of low prices of sale to the consuming public, thereby making such blasting cap initiator system economically available to the buying public.

Even still another object of the present invention is to provide a blasting cap initiator system for initiating a shot shell primer and then a shock tube which in turn activates a blasting cap in a safe and efficient manner.

Lastly, it is an object of the present invention to provide a new and improved blasting cap initiator system having a main housing with an imperforate lower wall, parallel side walls, and front and rear walls. An L-shaped locking slot is formed centrally in one side wall with a trigger recess formed in the top wall adjacent the rear wall and a cylindrical bore extending from the rear wall through the front wall. A firing pin is mounted for reciprocal movement within the bore between a retracted orientation and an advanced orientation. The firing pin has a centrally located circumferential groove. A trigger is pivotably mounted in the trigger recesses movable between a locking orientation with a finger engageable with the groove and a raised orientation to a disengage orientation. A pair of axial coil springs between the rear wall and the cylinders independently allow the advancement of the cylinders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken along line 3—3 of FIG. 2.

FIG. 4 is a cross-sectional view similar to FIG. 3 but showing the firing pin in the forward orientation.

The same reference numerals refer to the same parts throughout the various Figures.

DESCRIPTION OF THE PREFERRED EMBODIMENT

Figure 1:
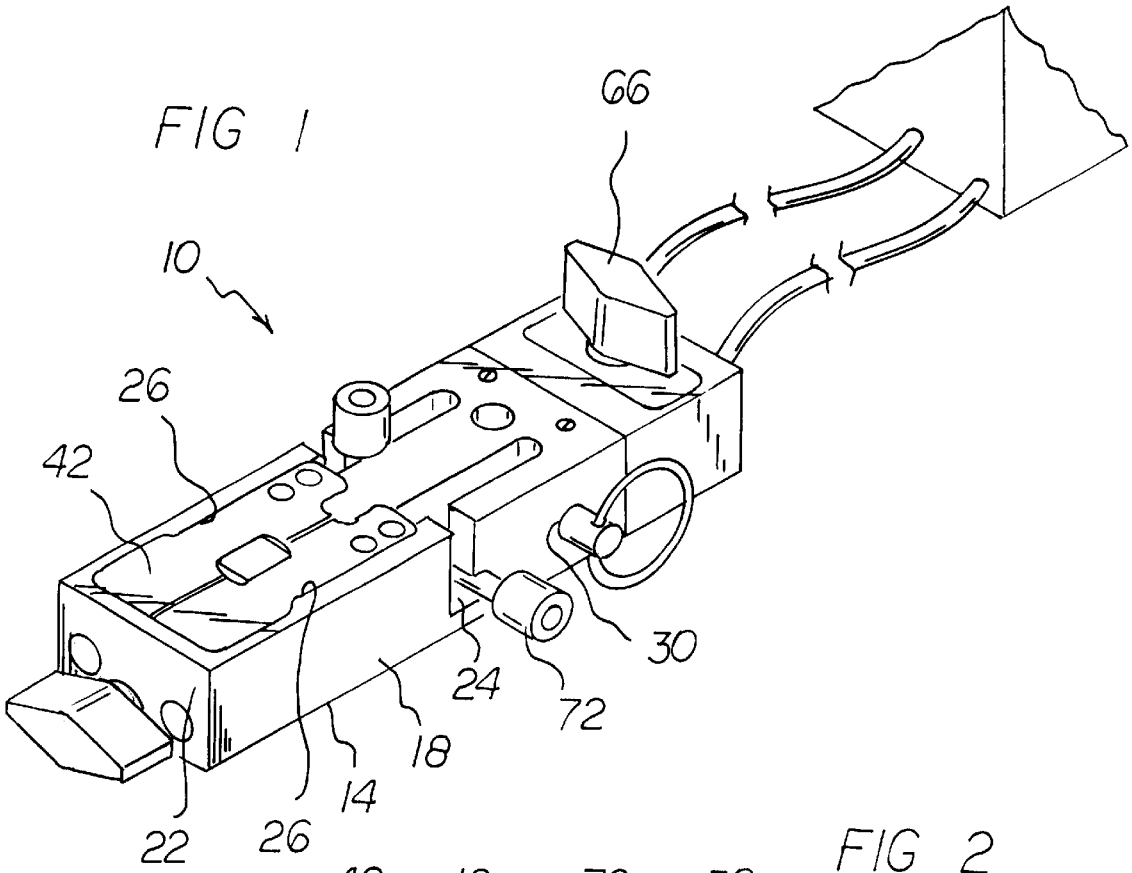
FIG. 1 a perspective view of the blasting cap initiator system constructed in accordance with the principles of the present invention.
Figure 2:
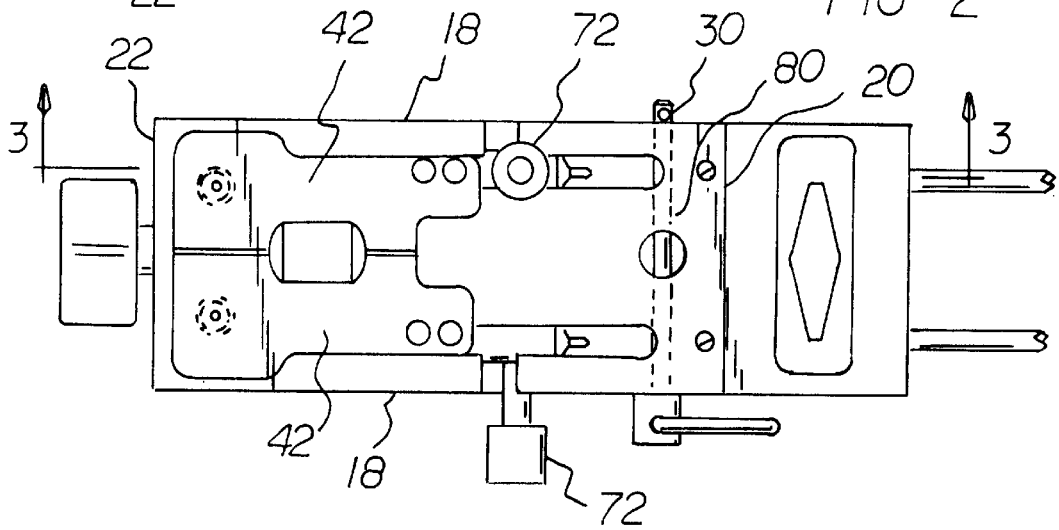
FIG. 2 is a top plan view of the system shown in FIG. 1.
Figure 5:
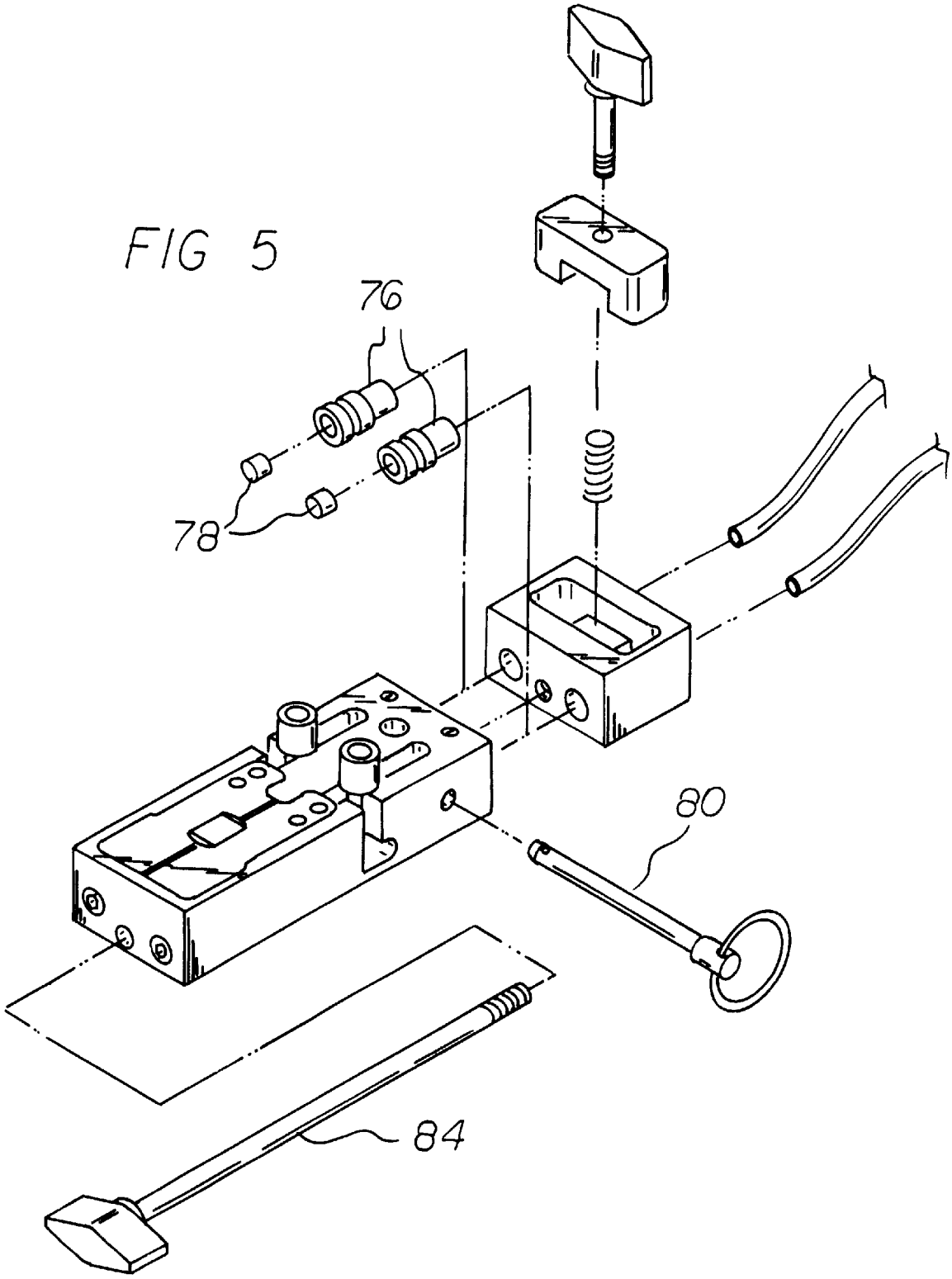
FIG. 5 is an exploded perspective view of the system.
Figure 6:
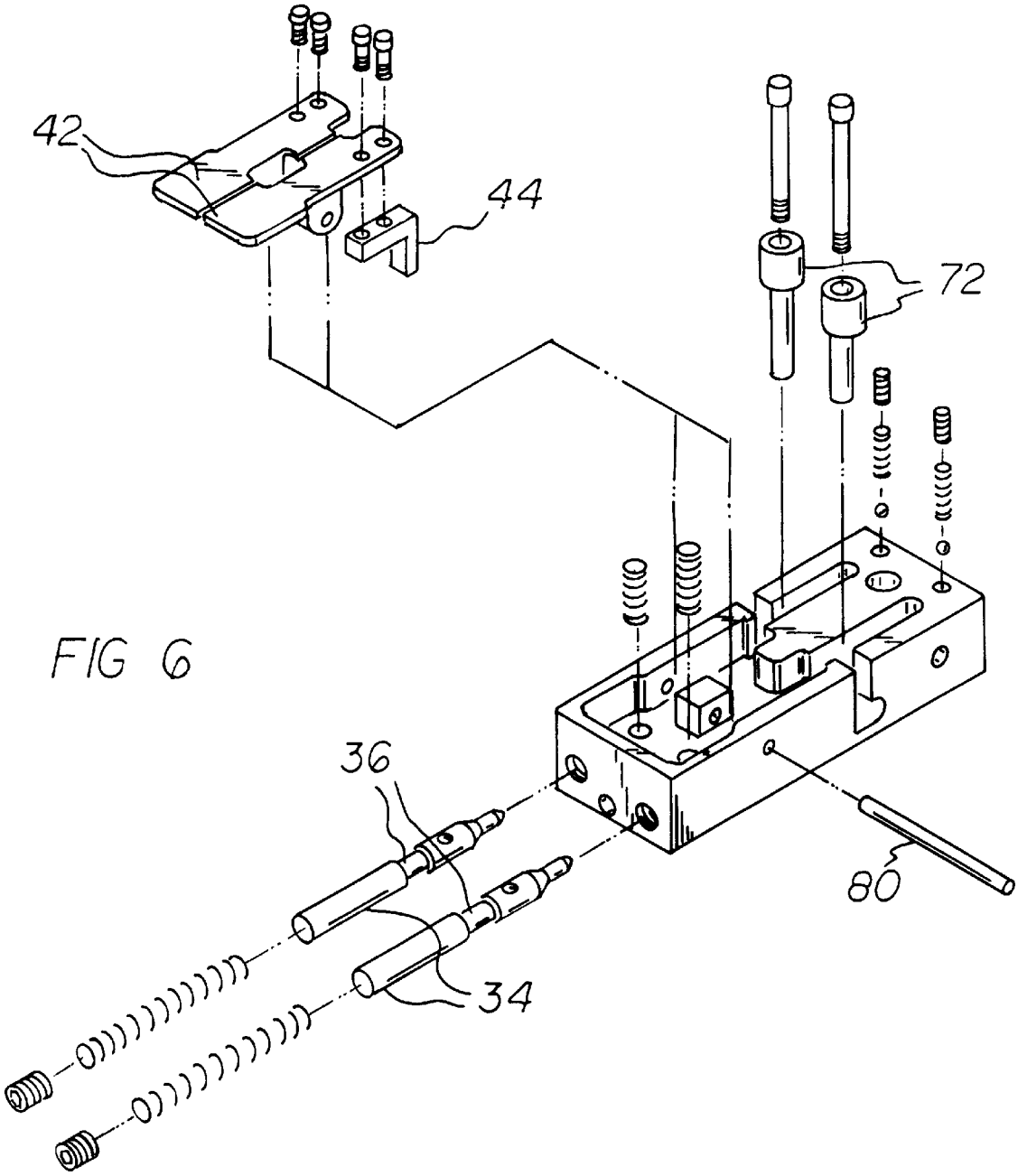
FIG. 6 is an exploded perspective view of the main housing.

With reference now to the drawings, and in particular to FIG. 1 thereof, the preferred embodiment of the new and improved blasting cap initiator system embodying the principles and concepts of the present invention and generally designated by the reference numeral 10 will be described.

The present invention, the blasting cap initiator system 10 is comprised of a plurality of components. Such components in their broadest context include a main housing, a firing pin, a trigger and a pair of axial coil springs. Such components are individually configured and correlated with respect to each other so as to attain the desired objective.

First provided is a main housing 14. The main housing has an imperforate lower wall 16, parallel side walls 18, and a front wall 20 and a rear wall 22. An L-shaped locking slot 24 is formed centrally in each side wall adjacent the rear wall. A pair of cylindrical bores 28 extend from the rear wall through the front wall. Safety apertures 30 are formed in the side wall adjacent to the front wall. The main housing also has trigger recesses 32.

Next provided is a pair of cylindrical firing pins 34. The firing pins are mounted for independent reciprocal movement within the bores between a retracted orientation adjacent to the rear wall. The firing pins are formed with a centrally located circumferential groove 36 and a forwardly extending point 38.

A pair of triggers 42 is next provided. The triggers are pivotably mounted in the trigger recesses and are independently movable to a locking orientation flat with the upper surface. The triggers have a finger 44 engageable with an associated groove for retaining the firing pin in a retracted orientation. The triggers are independently movable to a raised orientation to a disengaged orientation to allow the forward movement of the firing pins.

Next provided is a pair of axial coil springs 48. The axial coil springs are between the rear wall and the firing pins. The axial coil springs independently allow the advancement of the firing pins.

A pair of radial coil springs 52 is next provided. The radial coil springs urge the triggers to the locking orientation.

Further provided is a forward block 56. The forward block has a rearward wall 52 positionable in contact with the front wall of the main housing. Apertures 60 are aligned with the bores. The forward block has a recess 62 with a retention member 64 and a coupling thumb screw 66 supporting a pair of ignitor tubes 68 adjacent to the front wall of the housing.

Next provided is a radial cocking knob 72. The radial cocking knob is coupled to each trigger and functions to allow a user to independently withdraw a firing pin to a retracted position and is rotated within an L-shaped locking slot prior to locking by a trigger.

Two sleeves 76 are next provided. The sleeves span the housing and the forward block. The sleeves receive a shot shell primer 78 for being initiated by the firing pin point and then the shock tube 68 and finally a remote blasting cap.

Further provided is a locking safety rod 80. The locking safety rod is positionable through safety apertures of the housing.

Lastly, an elongated rod 84 is provided. The elongated rod extends through the length of the housing and is threadedly received by the forward block for the removal of a spent shot shell primer and the introduction of a new shot shell primer.

By way of further explanation, the present invention initiates a shock tube that in turn initiates a blasting cap. The basis for operation is a spring powered firing pin. The firing pin is pulled rearward by the cocking knob. At the rearward position the spring supported triggers cam into the groove in the firing pin and lock it in the cocked position. When the trigger is pressed the firing pin moves forward and strieks a shot shell primer. The blast initiates the shock tube. The shock tube acts as a fuse and rapidly (6,700 fps) runs down to the blasting cap and initiates the cap.

The uniqueness of this invention is simple. No other initiator incorporates the cocking, safety and trigger all in one component, the firing pin. There are initiators that may be cocked and put in safe mode but do not have a firing trigger. There are others that have a trigger but no safety combined with the bolt. There are no units that allow the user to cock, place the unit in and out of safe mode, and still have the ability to trigger fire at any time. The prior art patents may be cocked and placed in safe mode but to fire you must let your finger slip off the bolt. The industry recognizes this to be unsafe and unreliable. The simple addition of a groove completely around the rear of the firing pin allows the user to rotate the firing pin in and out of safe mode but still be in the cocked position.

In summary, this invention is unique in that it incorporates all the items necessary to operate the units; cock, place in and out of safe mode, and trigger fire the unit; in the design of only one component, the firing pin or bolt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A blasting cap initiator system for initiating a shot shell primer and then a shock tube which in turn initiates a blasting cap in a safe and efficient manner comprising, in combination:

a main housing having an imperforate lower wall, parallel side walls, and a front wall and a rear wall, with an L-shaped locking slot formed centrally in each side wall adjacent the rear wall and a pair of cylindrical bores extending from the rear wall through the front wall and with safety apertures formed in the side wall adjacent to the front wall, and with trigger recesses;

a pair of cylindrical firing pins mounted for independent reciprocal movement within the bores between a retracted orientation adjacent to the rear wall, the firing pins formed with a centrally located circumferential groove 36 and a forwardly extending point;

a pair of triggers pivotably mounted in the trigger recesses and independently movable to a locking orientation flat with the upper surface and with a finger engageable with an associated groove for retaining the firing pin in a retracted orientation, the triggers independently movable to a raised orientation to a disengaged orientation to allow the forward movement of the firing pins;

a pair of axial coil springs between the rear wall and the firing pins to independently allow the advancement of the firing pins;

a pair of radial coil springs urging the triggers to the locking orientation;

a forward block having a rearward wall positionable in contact with the front wall of the main housing with apertures aligned with the bores, the forward block having a recess with a retention member and a coupling thumb screw supporting a pair of ignitor tubes adjacent to the front wall of the housing;

radial cocking knob coupled to each trigger to allow a user to independently withdraw a firing pin to a retracted position and rotated within an L-shaped locking slot prior to locking by a trigger;

two sleeves spanning the housing and the forward block receiving a shot shell primer for being ignited by the firing pin point and then the shock tube and finally a remote blasting cap;

a locking safety rod positionable through safety apertures of the housing; and an elongated rod extending through the length of the housing and threadedly received by the forward block for the removal of a spent shot shell primer and the introduction of a new shot shell primer.

2. A blasting cap initiator system comprising:

a main housing having an imperforate lower wall, parallel side walls, and a front wall and a rear wall, an L-shaped locking slot formed centrally in one side wall with a trigger recess formed in the top wall adjacent the rear wall and a pair of cylinders with cylindrical bore extending from the rear wall through the front wall of each;

a firing pin mounted for reciprocal movement within the bores between a retracted orientation and an advanced orientation, the firing pin having a centrally located circumferential groove;

a trigger pivotably mounted in the trigger recesses movable between a locking orientation with a finger engageable with the groove and a raised orientation to a disengage orientation; and a pair of axial coil springs between the rear wall and the cylinders to independently allow the advancement of the cylinders.

3. The system as set forth in claim 2 and further including a forward block for retaining a shock tube in an operative position.

4. The system as set forth in claim 2 and further including a second firing pin and a second trigger for independent operation.

5. The system as set forth in claim 2 and further including a locking safety rod positionable across the bore adjacent to the front wall.

* * * * *